US011499107B2

(12) United States Patent
Southby et al.

(10) Patent No.: US 11,499,107 B2
(45) Date of Patent: Nov. 15, 2022

(54) LIQUID FUEL COMPOSITIONS

(71) Applicant: SHELL OIL COMPANY, Houston, TX (US)

(72) Inventors: Mark Clift Southby, London (GB); Renate Uitz-Choi, Hamburg (DE); Roger Francis Cracknell, Manchester (GB); Joseph Michael Russo, Houston, TX (US); Neal Matthew Morgan, London (GB); Artemis Kontou, London (GB)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 17/256,491

(22) PCT Filed: Jul. 1, 2019

(86) PCT No.: PCT/EP2019/067585
§ 371 (c)(1),
(2) Date: Dec. 28, 2020

(87) PCT Pub. No.: WO2020/007790
PCT Pub. Date: Jan. 9, 2020

(65) Prior Publication Data

US 2021/0277319 A1 Sep. 9, 2021

Related U.S. Application Data

(60) Provisional application No. 62/692,950, filed on Jul. 2, 2018.

(51) Int. Cl.

| | |
|---|---|
| ***C10L 1/238*** | (2006.01) |
| ***C10L 10/08*** | (2006.01) |
| ***C10M 137/10*** | (2006.01) |
| ***C10M 149/02*** | (2006.01) |
| ***C10M 161/00*** | (2006.01) |
| ***C10M 169/04*** | (2006.01) |
| ***C10N 30/04*** | (2006.01) |
| ***C10N 40/25*** | (2006.01) |
| ***C10N 20/04*** | (2006.01) |
| ***C10N 30/06*** | (2006.01) |

(52) U.S. Cl.

CPC ..... *C10L 1/238* (2013.01); *C10L 10/08* (2013.01); *C10M 137/10* (2013.01); *C10M 149/02* (2013.01); *C10M 161/00* (2013.01); *C10M 169/044* (2013.01); *C10L 2200/0423* (2013.01); *C10L 2200/0446* (2013.01); *C10L 2270/023* (2013.01); *C10L 2270/026* (2013.01); *C10M 2203/003* (2013.01); *C10M 2217/06* (2013.01); *C10M 2223/045* (2013.01); *C10N 2020/04* (2013.01); *C10N 2030/041* (2020.05); *C10N 2030/06* (2013.01); *C10N 2040/252* (2020.05); *C10N 2040/255* (2020.05)

(58) Field of Classification Search

CPC .. C10L 1/238; C10L 10/08; C10L 2200/0423; C10L 2200/0446; C10L 2270/023; C10L 2270/026; C10M 137/10; C10M 149/02; C10M 161/00; C10M 169/044; C10M 2203/003; C10M 2217/06; C10M 2223/045; C10N 2020/04; C10N 2030/041; C10N 2030/06; C10N 2040/252; C10N 2040/255; C10N 2030/04; C10N 2040/25; C10N 2010/04

See application file for complete search history.

(56) References Cited

U.S. PATENT DOCUMENTS

| | | | | |
|---|---|---|---|---|
| 4,208,190 | A | | 6/1980 | Malec |
| 4,849,572 | A | | 7/1989 | Chen et al. |
| 4,877,416 | A | | 10/1989 | Campbell |
| 4,881,945 | A | * | 11/1989 | Buckley, III ..... C10L 1/238 44/387 |
| 5,039,307 | A | | 8/1991 | Herbstman et al. |
| 5,122,161 | A | | 6/1992 | Benfaremo et al. |
| 5,288,393 | A | | 2/1994 | Jessup et al. |
| 5,378,348 | A | | 1/1995 | Davis et al. |
| 5,490,864 | A | | 2/1996 | Herbstman et al. |
| 5,588,973 | A | | 12/1996 | Blackborow et al. |
| 5,766,274 | A | | 6/1998 | Wittenbrink et al. |
| 5,855,629 | A | | 1/1999 | Grundy et al. |
| 5,888,376 | A | | 3/1999 | Wittenbrink et al. |
| 6,039,772 | A | | 3/2000 | Orr |
| 6,204,426 | B1 | | 3/2001 | Miller et al. |

(Continued)

FOREIGN PATENT DOCUMENTS

| | | |
|---|---|---|
| DE | 1142241 A1 | 6/1993 |
| DE | 19620262 A1 | 11/1997 |

(Continued)

OTHER PUBLICATIONS

International Search Report and Written Opinion Received for PCT Application No. PCT/EP2004/051160, dated Sep. 30, 2004, 10 pages.

(Continued)

*Primary Examiner* — Pamela H Weiss
(74) *Attorney, Agent, or Firm* — Shell USA, Inc.

(57) ABSTRACT

Use of a liquid fuel composition in an internal combustion engine, the internal combustion engine containing a lubricating composition for lubricating said internal combustion engine, wherein the liquid fuel composition comprises at least one nitrogen-containing detergent additive, for the purpose of reducing engine wear caused by the presence of soot in the lubricating composition.

5 Claims, No Drawings

(56) References Cited

U.S. PATENT DOCUMENTS

| | | | | |
|---|---|---|---|---|
| 6,267,791 | B1 | 7/2001 | Thomas et al. | |
| 6,290,734 | B1 | 9/2001 | Scott et al. | |
| 7,413,583 | B2 * | 8/2008 | Langer | C10M 167/00 44/301 |
| 8,518,130 | B2 | 8/2013 | Croft et al. | |
| 2002/0045785 | A1 | 4/2002 | Bazzani et al. | |
| 2002/0058593 | A1 | 5/2002 | Bovington et al. | |
| 2002/0068842 | A1 | 6/2002 | Brundage et al. | |
| 2002/0143216 | A1 | 10/2002 | Tsurutani et al. | |
| 2003/0094397 | A1 | 5/2003 | Ignatius et al. | |
| 2004/0077507 | A1 | 4/2004 | Lange et al. | |
| 2006/0277819 | A1 | 12/2006 | Puri et al. | |
| 2009/0277409 | A1 * | 11/2009 | Selby | C10M 107/02 123/1 A |
| 2011/0041792 | A1 | 2/2011 | Felix-Moore et al. | |
| 2011/0154727 | A1 | 6/2011 | Brewer et al. | |
| 2011/0154728 | A1 | 6/2011 | Felix-Moore et al. | |
| 2016/0289584 | A1 * | 10/2016 | Russo | C10L 1/18 |
| 2020/0095516 | A1 | 3/2020 | SouthBy et al. | |

FOREIGN PATENT DOCUMENTS

| | | | |
|---|---|---|---|
| DE | 19955651 | A1 | 5/2001 |
| EP | 0310875 | A1 | 4/1989 |
| EP | 0356725 | A1 | 3/1990 |
| EP | 0583836 | A1 | 2/1994 |
| EP | 0700985 | A1 | 3/1996 |
| EP | 0831141 | A1 | 3/1998 |
| EP | 1101813 | A1 | 5/2001 |
| WO | 9424231 | A1 | 10/1994 |
| WO | 9533805 | A1 | 12/1995 |
| WO | 9603397 | A1 | 2/1996 |
| WO | 9703946 | A1 | 2/1997 |
| WO | 9714768 | A1 | 4/1997 |
| WO | 9714769 | A1 | 4/1997 |
| WO | 9801516 | A1 | 1/1998 |
| WO | 9932584 | A1 | 7/1999 |
| WO | 0011116 | A1 | 3/2000 |
| WO | 0011117 | A1 | 3/2000 |
| WO | 0020534 | A1 | 4/2000 |
| WO | 0020535 | A1 | 4/2000 |
| WO | 0077130 | A1 | 12/2000 |
| WO | 0172930 | A1 | 10/2001 |
| WO | 0183406 | A2 | 11/2001 |
| WO | 0183641 | A1 | 11/2001 |
| WO | 0183647 | A1 | 11/2001 |
| WO | 0183648 | A2 | 11/2001 |
| WO | 0216531 | A2 | 2/2002 |
| WO | 0231090 | A1 | 4/2002 |
| WO | 03076554 | A1 | 9/2003 |
| WO | 2008135602 | A2 | 11/2008 |
| WO | 2009050287 | A1 | 4/2009 |
| WO | 2009077606 | A2 | 6/2009 |
| WO | 2010000761 | A1 | 1/2010 |
| WO | 2010028206 | A1 | 3/2010 |
| WO | 2012163935 | A2 | 12/2012 |

OTHER PUBLICATIONS

Ratoi et al., "The Influence of Soot and Dispersant on ZDDP Film Thickness and Friction", Lubrication Science, vol. 17, Issue No. 1, ISSN 0954-0075, Nov. 1, 2004, pp. 25-43, XP55414046.

Olomolehin et al., "Antagonistic Interaction of Antiwear Additives and Carbon Black", Tribology Letters, vol. 37, Issue No. 1, ISSN: 1573-2711, Jul. 28, 2009, pp. 49-58, XP019775039.

Remmert et al., "Demonstration of Fuel Economy Benefit of Friction Modifier Additives via Fuel-to-lubricant Transfer in Euro-5 Gasoline Fleet", SAE International Journal of Fuels and Lubricants, vol. 6, Issue No. 3, Apr. 15, 2013, pp. 377-690, XP55620255.

Motamen et al., "Corrosive-Abrasive Wear Induced by Soot in Boundary Lubrication Regime", Trib Letters 63, 2016, pp. 1-11.

Rocca et al., "The Nanostructure of Soot-in-oil Particles and Agglomerates From an Automotive Diesel Engine", Tribology International, vol. 61, May 2013, pp. 80-87.

Henkel et al., "Injector Fouling and Its Impact on Engine Emissions and Spray Characteristics in Gasoline Direct Injection Engines", SAE Int. J. Fuels Lubr, vol. 10, Issue No. 2, 2017, pp. 287-295.

Wei et al., "The Lubricity of Diesel Fuel", Wear, vol. 111, Issue No. 2, Sep. 1986, pp. 217-235.

Kopp et al., Heavy Hydrocarbon / Volatility Study: Fuel Blending andAnalysis for the Auto/Oil Air Quality Improvement Research Program , SAE Paper No. 930143, SAE Technical Paper Series, Society of Automotive Engineers Congress, Detroit, Mar. 1-5, 1993, pp. 99 to 124.

Pahl et al., "Fuel Blending and Analysis for the Auto/Oil Air Quality Improvement Research Program", SAE Paper No. 902098, International Fuels & Lubricants Meeting & Exposition, 1990, 11 pages.

Gerry et al., "Test Fuels: Formulation and Analyses—The Auto/Oil Air Quality Improvement Research Program", SAE Paper No. 920324, International Congress & Exposition, 1992, pp. 335 to 357.

Wigg et al., "The Effect of Fuel Hydrocarbon Composition on Exhaust Hydrocarbon and Oxygenate Emissions", SAE Paper No. 720251, Automotive Engineering Congress and Exposition, 1972, 18 pages.

Lillywhite et al., "Field Trial to Investigate the Effect of Fuel Composition and Fuel-Lubricant Interaction on Sludge Formation in Gasoline Engines", SAE Paper 922218, International Fuels and Lubricants Meeting and Exposition, Oct. 19-22, 1992, 10 pages.

Othmer, "Encyclopedia of Chemical Technology", 4th edition, vol. 4, p. 725.

Hocnnauser et al., "The Effect of Aromatics, MTBE, Olefins and T90 on Mass Exhaust Emissions from Current and Older Vehicles—The Auto/Oil Air Quality Improvement Research Program", 41 pages.

"Automotive Fuels Unleaded Petrol Requirements and Test Methods", BS EN 228:2000, ISBN 058034956X, vol. 0313, 2011, 24 pages.

"Standard Test Method for Hydrocarbon Types in Liquid Petroleum Products by Fluorescent Indicator Adsorption", ASTM D1319—20a, 8 pages.

"Setting National Fuel Quality Standards", Paper 1, Summary Report of the Review of Fuel Quality Requirements for Australian Transport, May 2000, 1 page.

Moritani et al., "Effects of Fuel Composition on Sludge Formation", Jul. 1991, 4 pages.

"Standard Test Method for Distillation of petroleum Products at Atmospheric Pressure", 22 Pages.

Rogers et al., "Formation and Additive Action", Mechnism of Engine Sludge, vol. 64, 1956, 20 pages.

Jaynes et al., "Investigations of Lubricant Sludge Formation in the Field: Development of an Effective New Fleet Test Technique", SAE Technical Paper Series 910748, 1991, 19 pages.

Georgi, "Motor Oils and Engine Lubrication", 1959, 6 pages.

"Petroleum Products—Determination of Distillation Characteristics at Atmospheric Pressure", International Standard, ISO 3405:2000(E), Mar. 2000, 31 pages.

Roarty et al., "Fuel Ethanol: Background and Policy Issues", Current Issues Brief, Issue No. 12, 2003, pp. 1-28.

Schubert et al., Cooperative Study to Evaluate a Standard Test Method for the Speciation of Gasolines by Capillary Gas Chromatography, 930144, 2011, 26 Pages.

Beens et al., "A Comparison of Ten Different Methods for the Analysis of Saturates, Olefins, Benzene, Total Aromatics, and Oxygenates in Finished Gasolines", Journal of Chromatographic Science, vol. 41, Nov./Dec. 2003, 7 pages.

Van Arkel et al., "Automated PNA Analysis of Naphthas and other Hydrocarbon Samples", Journal of Chromatographic Science, vol. 25, Apr. 1987, 2 pages.

"Standard Test Method for Determination of Individual Components in Spark Ignition Engine Fuels bu 100-Metre Capillary (with precolumn) High Resolution Gas Chromatography", An American National Standard, D6730-01, 1 page.

Statutory Declaration by Leon Gerard Halliburton, Apr. 28, 2011, in the matter of Australian Patent Application No. 2004249899, 120 pages.

(56) References Cited

OTHER PUBLICATIONS

Appendix-3, Summary of Opponent Calculations, 1 Page.
Novelty Attack Based on O20, SAE 720251, Tables A-1 and A-2, 1 page.
Statement of Ground of Opposition, 2009, 10 pages.
Appendix-2, Supporting Data, Part 1: Fuel 1B, 21 pages.
Statutory Declaration by Duncan Seddon in the matter of Australian Patent Application No. 2004249899, 42 pages.
Cross Reference Table of Prior Art Documents cited in Australian(AU) and European(EP) Oppositions, Appendix-1, 1 page.
BP produces ethanol/petrol blend in Australia, Reuters, Aug. 22, 2002, 1 Page.
Office Action Received for China Application No. 201980044064.2, dated Jan. 25, 2022, 16 Pages (09 Pages of English Translation and 07 Pages of Official Copy).
Office Action Received for Indian Application No. 202017052786, dated Jul. 19, 2022, 7 Pages(7 Pages of Official Copy).
Barnes et al., "A Review of Zinc Dialkyldithiophosphates (Zddps): Characterisation and Role in the Lubricating Oil", Tribology International, vol. 34, Issue No. 6, Jun. 1, 2001, pp. 389-395.
Bartha et al., "Interaction of Pib-succinimides and Other Engine Oil Additives", Lubrication Science, Mar. 2, 2006, vol. 9, Issue No. 2, pp. 173-180.

* cited by examiner

LIQUID FUEL COMPOSITIONS

CROSS REFERENCE TO RELATED APPLICATIONS

This is a national stage application of International Application No. PCT/EP2019/067585, filed 1 Jul. 2019, which claims benefit of priority to U.S. Provisional Application No. 62/692,950, filed 2 Jul. 2018.

FIELD OF THE INVENTION

The present invention relates to the use of a liquid fuel composition in an internal combustion engine for reducing engine wear, in particular for reducing engine wear caused by the presence of soot in lubricating engine oil compositions, in particular in lubricating engine oil compositions comprising zinc-containing anti-wear compounds.

BACKGROUND OF THE INVENTION

Increasingly severe automobile regulations in respect of emissions and fuel efficiency are placing increasing demands on both engine manufacturers and lubricant formulators to provide effective solutions to improve fuel economy.

Optimising lubricants through the use of high performance basestocks and novel additives represents a flexible solution to a growing challenge.

Anti-wear additives, such as organomolybdenum and zinc-containing anti-wear compounds, are important to mitigate issues arising from the desire to have low viscosity formulations in order to reduce fuel consumption and various such additives are already known in the art.

A common anti-wear additive which is well known for use in lubricating compositions is a zinc dithiophosphate, such as, for example, zinc dialkyl-, diaryl- or alkylaryldithiophosphates. Zinc dithiophosphate may be conveniently represented by general formula II:

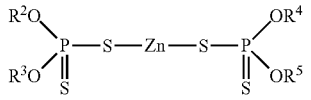

(II)

wherein $R^2$ to $R^5$ may be the same or different and are each a primary alkyl group containing from 1 to 20 carbon atoms preferably from 3 to 12 carbon atoms, a secondary alkyl group containing from 3 to 20 carbon atoms, preferably from 3 to 12 carbon atoms, an aryl group or an aryl group substituted with an alkyl group, said alkyl substituent containing from 1 to 20 carbon atoms, preferably 3 to 18 carbon atoms.

Examples of suitable zinc dithiophosphates which are commercially available include those available ex. Lubrizol Corporation under the trade designations "Lz 1097" and "Lz 1395", those available ex. Chevron Oronite under the trade designations "OLOA 267" and "OLOA 269R", and that available ex. Afton Chemical under the trade designation "HITEC 7197", zinc dithiophosphates such as that available from Infineum under the tradename Infineum C9417, those available from Lubrizol Corporation under the trade designations "Lz 677A", "Lz 1095" and "Lz 1371", that available ex. Chevron Oronite under the trade designation "OLOA 262" and that available ex. Afton Chemical under the trade designation "HITEC 7169", zinc dithiophosphates such as those available ex. Lubrizol Corporation under the trade designations "Lz 1370" and "Lz 1373" and that available ex. Chevron Oronite under the trade designation "OLOA 260".

These zinc-based anti-wear additives can be used on their own or in combination with other anti-wear additives such as organomolybdenum anti-wear compounds.

While zinc dithiophosphate compounds are useful for reducing wear in lubricating compositions, it has been recently found that in the presence of soot, the zinc dithiophosphate layer on the metal surfaces of the engine can be removed by the soot, thereby increasing the wear via a specifically identified wear mechanism. The wear mechanism of corrosion/abrasion was identified and published in 2010, see Olomolehin, Y., Kapadia, R. G., Spikes, H. A., "Antagonistic interaction of antiwear additives and carbon black." Trib Letters 37, 49-58, (2009). A more recent paper has recently reaffirmed this mechanism, see Salehi, F. Motamen, D. N. Khaemba, A. Morina, and A. Neville, "Corrosive-Abrasive Wear Induced by Soot in Boundary Lubrication Regime." Trib Letters 63, 1-11, (2016).

A similar problem may also exist in the context of synthetic diamond like coatings (DLC) which are used on contacts within internal combustion engines and may be removed by the presence of soot in the lubricant.

In addition to the problems identified in the two Trib Letters papers mentioned above in the context of zinc dithiophosphate compounds, the presence of soot in a lubricating composition can cause problems for engine wear even in the absence of metal-based anti-wear compounds.

Attempts have been made to deal with the problem of soot in lubricating formulations, for example by including molecules within the lubricating formulations that can act as dispersants so that the soot molecules are dispersed within the bulk of the lubricant. However the amount of dispersant present in the lubricant may not always be adequate.

Further, gasoline lubricants are not always formulated to be able to handle significant amounts of combustion soot. Historically, spark ignition combustion has not produced very much soot, but the introduction of direct injection combustion has led to rich regions of combustion, and consequently soot generation.

Further, although a lubricant formulation may be able to adequately disperse any combustion soot particles when fresh, its ability to do this will decrease as the lubricant degrades and the soot concentration increases. A lubricant composition typically degrades over an 'oil drain interval'. One metric of this degradation is a decrease in the total base number (TBN) of the lubricant which in part reflects the concentration of amine groups.

It would therefore be desirable to find a way to reduce engine wear of lubricating compositions in the presence of soot, in particular when the lubricating composition contains a zinc-based anti-wear additive.

It has now surprisingly been found that by using certain nitrogen-containing detergents in the liquid fuel compositions used to fuel an internal combustion engine, there is observed a reduction in the engine wear caused by the presence of soot in lubricating engine oil compositions, particularly in lubricating engine oil compositions comprising zinc-based anti-wear additives such as zinc dithiophosphate (ZTP) compounds and zinc dialkyldithiophosphate (known as 'ZDDP' or 'ZDTP') compounds.

European patent application 17168538.1 relates to the use of a nitrogen-containing ashless dispersant in a lubricating composition for the purpose of reducing wear in the presence of zinc dithiophosphate compounds and soot. In one embodiment therein, the nitrogen-containing ashless dispersant comprises at least one polyisobutylene succinimide. However, there is no disclosure in this document of the use of a nitrogen-containing detergent in a fuel composition for providing reduced engine wear caused by the presence of soot in a lubricating engine oil composition, in particular in a lubricating engine oil composition containing zinc-based anti-wear compounds such as zinc dithiophosphate (ZTP) and zinc dialkyl dithiophosphate (ZDTP) compounds.

SUMMARY OF THE INVENTION

According to the present invention there is provided the use of a liquid fuel composition in an internal combustion engine, the internal combustion engine containing a lubricating composition for lubricating said internal combustion engine, wherein the liquid fuel composition comprises at least one nitrogen-containing detergent additive, for the purpose of reducing engine wear caused by the presence of soot in said lubricating composition.

DETAILED DESCRIPTION OF THE INVENTION

As used herein the term "soot" means a deep black powdery or flaky substance consisting largely of amorphous carbon. Gas-phase soot contains polycyclic aromatic hydrocarbons (PAH). Soot is produced by the incomplete burning of organic matter, such as hydrocarbon based fuels. It consists of agglomerated nanoparticles with diameters between 6 and 30 nm. The soot particles can be mixed with metal oxides and with minerals and can be coated with sulfuric acid. Fresh lubricant is typically free of soot, however can become contaminated with soot during fuel combustion. In the context of an internal combustion engine, soot can travel from the combustion chamber via the blow-by into the lubricant and can accumulate in the lubricant. This mechanism is described in the following paper: La Rocca, A., Di Liberto, G., Shayler, P. J. and Fay, M. W., 2013; 'The nanostructure of soot-in-oil particles and agglomerates from an automotive diesel engine'; Tribology International. 61(May), 80-87.

In the context of the present invention, the amount of accumulated soot present in the lubricating composition is typically at a level of from 0.1 wt % to 10 wt %, by weight of the lubricating composition. In one embodiment, the level of soot is from 2 to 7 wt %, by weight of the lubricating composition. In another embodiment, the level of soot is from 3.5 to 7 wt %, by weight of the lubricating composition. In another embodiment, the level of soot is from 5 to 6 wt %, by weight of the lubricating composition.

There are no limits on the type of lubricating composition which can be used herein as long as it is suitable for lubricating an internal combustion engine. Generally a typical lubricating composition for use herein will comprise a base oil, an anti-wear additive, such as a zinc-containing anti-wear additive and one or more additional additive components.

As mentioned above, a suitable anti-wear additive which is well known for use in lubricating compositions is a zinc dithiophosphate, such as, for example, zinc dialkyl-, diaryl- or alkylaryl-dithiophosphates.

The liquid fuel composition of the present invention comprises a nitrogen-containing detergent additive.

As described below, the nitrogen-containing detergent additive can transfer from the fuel composition to the lubricant composition during the fuel combustion process. Once the nitrogen-containing detergent additive has transferred from the fuel composition to the lubricating composition, it is typically referred to as a nitrogen-containing dispersant.

Preferred nitrogen-containing detergent additives for use in the liquid fuel composition herein typically have at least one hydrophobic hydrocarbon radical having a number-average molecular weight (Mn) of from 85 to 20000 and at least one polar moiety selected from:

(A1) mono- or polyamino groups having up to 6 nitrogen atoms, of which at least one nitrogen atom has basic properties;

(A2) polyoxy-$C_2$-to-$C_4$-alkylene groups which are terminated mono- or polyamino groups, in which at least one nitrogen atom has basic properties, or by carbamate groups;

(A3) moieties derived from succinic anhydride and having amido and/or imido groups; and/or (A4) moieties obtained by Mannich reaction of substituted phenols with aldehydes and mono- or polyamines.

The nitrogen-containing detergent additive for use herein can also be selected from mixtures of the compounds defined by (A1)-(A4) above.

In a preferred embodiment herein, the polar moiety is selected from (A3) moieties derived from succinic anhydride and having amido and/or imido groups.

The hydrophobic hydrocarbon radical in the above detergent additives, which ensures adequate solubility in the base fluid, has a number-average molecular weight (Mn) of from 85 to 20,000, especially from 113 to 10,000, in particular from 300 to 5000. Typical hydrophobic hydrocarbon radicals, especially in conjunction with the polar moieties (A1), (A3) and (A4), include polyalkenes (polyolefins), such as the polypropenyl, polybutenyl and polyisobutenyl radicals, and mixtures thereof, each having Mn of from 300 to 5000, preferably from 500 to 2500, more preferably from 700 to 2300, and especially from 700 to 1000.

Non-limiting examples of the above groups of nitrogen-containing detergent additives include the following:

Additives comprising mono- or polyamino groups (A1) are preferably polyalkenemono- or polyalkenepolyamines based on polypropene or conventional (i.e. having predominantly internal double bonds) polybutene or polyisobutene having Mn of from 300 to 5000. When polybutene or polyisobutene having predominantly internal double bonds (usually in the beta and gamma position) are used as starting materials in the preparation of the additives, a possible preparative route is by chlorination and subsequent amination or by oxidation of the double bond with air or ozone to give the carbonyl or carboxyl compound and subsequent amination under reductive (hydrogenating) conditions. The amines used here for the amination may be, for example, ammonia, monoamines or polyamines, such as dimethylaminopropylamine, ethylenediamine, diethylenetriamine, triethylenetetramine or tetraethylenepentamine. Corresponding additives based on polypropene are described in particular in WO-A-94/24231.

Further preferred additives comprising monoamino groups (A1) are the hydrogenation products of the reaction products of polyisobutenes having an average degree of polymerization of from 5 to 100, with nitrogen oxides or mixtures of nitrogen oxides and oxygen, as described in particular in WO-A-97/03946.

Further preferred additives comprising monoamino groups (A1) are the compounds obtainable from polyisobutene epoxides by reaction with amines and subsequent dehydration and reduction of the amino alcohols, as described in particular in DE-A-196 20 262.

Additives comprising polyoxy-$C_2$-$C_4$-alkylene moieties (A2) are preferably polyetheramines which are obtainable by reaction of $C_2$- to $C_{60}$-alkanols, $C_6$- to $C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group and by subsequent reductive amination with ammonia, monoamines or polyamines. Also suitable herein are polyetheramines containing mixtures of ethylene oxide and/or propylene oxide and/or butylene oxide. Such products are described in particular in EP-A-310 875, EP-A-356 725, EP-A-700 985 and U.S. Pat. No. 4,877,416. Typical examples of these are the reaction product between ammonia and one of the following compounds: tridecanol butoxylates, isotridecanol butoxylates, isononylphenol butoxylates and polyisobutenol butoxylates and propoxylates.

Additives comprising moieties derived from succinic anhydride and having amido and/or imido groups (A3) are preferably corresponding derivatives of polyisobutenylsuccinic anhydride which are obtainable by reacting conventional or highly reactive polyisobutene having Mn of from 300 to 5000 with maleic anhydride by a thermal route or via the chlorinated polyisobutene. Of particular interest are derivatives with aliphatic polyamines such as ethylenediamine, diethylenetriamine, triethylenetetramine or tetraethylenepentamine. Such additives are described in particular in U.S. Pat. No. 4,849,572.

Additives comprising moieties obtained by Mannich reaction of substituted phenols with aldehydes and mono- or polyamines (A4) are preferably reaction products of polyisobutene-substituted phenols with formaldehyde and mono- or polyamines such as ethylenediamine, diethylenetriamine, triethylenetetramine, tetraethylenepentamine or dimethylaminopropylamine. The polyisobutenyl-substituted phenols may stem from conventional or highly reactive polyisobutene having Mn of from 300 to 5000. Such "polyisobutene-Mannich bases" are described in particular in EP-A-831 141.

Preferably, the nitrogen-containing detergent additive is selected from a group comprising polyalkene monoamines, polyetheramines, polyalkene Mannich amines and polyalkene succinimides, and mixtures thereof.

In a preferred embodiment herein, the nitrogen-containing detergent additive is a polyalkene succinimide, preferably a polyisobutenyl (PIB) succinimide. PIB succinimide compounds are known as dispersant additives in the art of fuel and lubricant composition and therefore are not further described herein. Suitable PIB succinimides can be obtained, for example, from Infineum under the trade designation Infineum C9280, and Chevron Oronite under the trade designation OLOA 11000.

The nitrogen-containing detergent additive is present in the liquid fuel composition (on an active matter basis, i.e. not including any solvent/carrier fluid materials and the like) at a level of from 0.001 wt % to 0.1 wt %, preferably from 0.0015 wt % to 0.095 wt %, more preferably from 0.0017 wt % to 0.07 wt %, and especially from 0.0019 wt % to 0.04 wt %, by weight of the fuel composition. When the liquid fuel composition is a gasoline fuel composition, the nitrogen-containing deposit control additive is preferably present (on an active matter basis, i.e. not including any carrier/solvent fluid materials and the like) at a level of from 0.0019 wt % to 0.04 wt %, more preferably from 0.002 wt % to 0.035 wt %, by weight of the liquid fuel composition. When the liquid fuel composition is a diesel fuel composition, the nitrogen-containing detergent additive is preferably present in the same levels as given above for gasoline fuel compositions.

The nitrogen-containing detergent additive is used herein in the liquid fuel composition to reduce the engine wear exhibited by the lubricating composition in the presence of soot, preferably wherein the lubricating composition comprises a zinc-containing anti-wear additive. Hence the term "reducing engine wear" as used herein means reducing the level of engine wear to a level below that exhibited by a lubricating composition, preferably a lubricating composition comprising a zinc-containing anti-wear additive such as a zinc dithiophosphate, which is contaminated with soot but wherein the liquid fuel composition used to fuel the internal combustion engine does not contain the nitrogen-containing detergent additive described herein.

In a preferred embodiment herein, the nitrogen-containing detergent additive is used to reduce the wear exhibited by a lubricating composition, preferably a zinc dithiophosphate-containing lubricating composition, in the presence of soot by at least 5%, more preferably by at least 10%, even more preferably by at least 50%, and especially by at least 80%, even more especially by at least 90%, compared with that of the same lubricating composition but wherein the liquid fuel composition used to fuel the internal combustion engine does not contain the nitrogen-containing detergent additive described herein.

While not wishing to be limited by theory, it is believed that the use of the selected nitrogen-containing detergent additive(s) mentioned herein within the fuel composition leads to a lower soot concentration in the combustion chamber. Injector fouling leads to a degradation in the combustion performance of an engine, for example, a direct injection spark ignition engine, of which one symptom is a significant and rapid increase in the amount of soot that is produced in the engine. The use of the selected nitrogen-containing detergent additive(s) helps to keep the injectors clean or cleans up existing deposits, as is described in Henkel, S., Hardalupas, Y., Taylor, A., Conifer, C. et al., "Injector Fouling and Its Impact on Engine Emissions and Spray Characteristics in Gasoline Direct Injection Engines," SAE Int. J. Fuels Lubr. 10(2):287-295, 2017. Further, the selected nitrogen-containing detergent additives are likely to transfer from the fuel to the lubricant hence helping to disperse any soot present in the combustion chamber. The following SAE paper describes the phenomenon of fuel additive transfer from gasoline fuel to the lubricant: S. Remmert, A. Felix-Moore, I. Buttery, P. Ziman and S. Smith, "Demonstration of FE benefit of friction modifier additives via fuel to lubricant transfer in Euro 5 gasoline fleet". SAE Paper 2013-01-2611.

The liquid fuel compositions herein comprise a base fuel. The base fuel is preferably selected from a gasoline base fuel or a diesel base fuel. If the base fuel is a gasoline base fuel then the liquid fuel composition of the present invention is a gasoline composition. If the base fuel is a diesel base fuel then the liquid fuel composition of the present invention is a diesel composition.

The nitrogen-containing detergent additive is typically blended together with one or more other additives to produce a performance additive package which is dosed into the fuel. The performance additive package may then be blended with one or more other additive components to produce an additive blend. The additive blend can then be added to a base fuel to produce a liquid fuel composition.

Alternatively, the nitrogen-containing detergent additive may be blended directly with the base fuel, preferably together with a solvent.

An optional, but preferred component of the additive blend, in addition to the nitrogen-containing detergent additive is a solvent. There are no particular limitations as to the type of solvent which may be used in the present invention, provided it is suitable for use in the additive blend. The use of a solvent in the additive blend provides improved stability properties and reduced viscosity.

Any solvent or mixtures of solvents suitable for use in fuels may be used herein. Examples of suitable solvents for use in fuels include: non-polar hydrocarbon solvents such as kerosene, heavy aromatic solvent ("solvent naphtha heavy", "Solvesso 150"), toluene, xylene, paraffins, petroleum, white spirits, those sold by Shell companies under the trademark "SHELLSOL", and the like. Further examples of suitable solvents include: polar solvents such as esters and, in particular, alcohols (e.g. t-butanol, i-butanol, hexanol, 2-ethylhexanol, 2-propyl heptanol, decanol, isotridecanol, butyl glycols, and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available).

The solvent is preferably present at a level of from 5 wt % to 50 wt %, more preferably at a level of from 5 wt % to 20 wt %, by weight of the additive blend (not including any solvent present in the performance additive package).

The amount of performance package(s) in the additive blend is preferably in the range of from 0.1 to 99.8 wt %, more preferably in the range of from 5 to 50 wt %, by weight of the additive blend.

Preferably, the amount of performance additive package present in the liquid fuel composition of the present invention is in the range of 15 ppmw (parts per million by weight) to 10% wt, based on the overall weight of the liquid fuel composition. More preferably, the amount of performance additive package present in the liquid fuel composition of the present invention additionally accords with one or more of the parameters (i) to (xv) listed below:

(i) at least 100 ppmw
(ii) at least 200 ppmw
(iii) at least 300 ppmw
(iv) at least 400 ppmw
(v) at least 500 ppmw
(vi) at least 600 ppmw
(vii) at least 700 ppmw
(viii) at least 800 ppmw
(ix) at least 900 ppmw
(x) at least 1000 ppmw
(xi) at least 2500 ppmw
(xii) at most 5000 ppmw
(xiii) at most 10000 ppmw
(xiv) at most 2% wt.
(xv) at most 5% wt.

The remainder of the composition will typically consist of one or more automotive base fuels optionally together with one or more fuel additives, for instance as described in more detail below.

Conventionally base fuels are present in a liquid fuel composition in a major amount, for example greater than 50 wt % of the liquid fuel composition, and may be present in an amount of up to 90 wt %, or 95 wt %, or 99 wt %, or 99.9 wt %, or 99.99 wt %, or 99.999 wt %. Suitably the liquid fuel composition contains or consists essentially of the base fuel in conjunction with the one or more nitrogen-containing detergent additives, and optionally one or more conventional fuel additives, such as specified hereinafter.

The relative proportions of the one or more nitrogen-containing detergent additives, base fuel components and any other components or additives present in a liquid fuel composition prepared according to the invention may also depend on other desired properties such as density, emissions performance and viscosity.

If the liquid fuel compositions of the present invention contain a gasoline base fuel, the liquid fuel composition is a gasoline fuel composition. The gasoline may be any gasoline suitable for use in an internal combustion engine of the spark-ignition (petrol) type known in the art, including automotive engines as well as in other types of engine such as, for example, off road and aviation engines. The gasoline used as the base fuel in the liquid fuel composition of the present invention may conveniently also be referred to as 'base gasoline'.

Gasolines typically comprise mixtures of hydrocarbons boiling in the range from 25 to 230° C. (EN-ISO 3405), the optimal ranges and distillation curves typically varying according to climate and season of the year. The hydrocarbons in a gasoline may be derived by any means known in the art, conveniently the hydrocarbons may be derived in any known manner from straight-run gasoline, synthetically-produced aromatic hydrocarbon mixtures, thermally or catalytically cracked hydrocarbons, hydro-cracked petroleum fractions, catalytically reformed hydrocarbons or mixtures of these.

The specific distillation curve, hydrocarbon composition, research octane number (RON) and motor octane number (MON) of the gasoline are not critical.

Conveniently, the research octane number (RON) of the gasoline may be at least 80, for instance in the range of from 80 to 110, preferably the RON of the gasoline will be at least 90, for instance in the range of from 90 to 110, more preferably the RON of the gasoline will be at least 91, for instance in the range of from 91 to 105, even more preferably the RON of the gasoline will be at least 92, for instance in the range of from 92 to 103, even more preferably the RON of the gasoline will be at least 93, for instance in the range of from 93 to 102, and most preferably the RON of the gasoline will be at least 94, for instance in the range of from 94 to 100 (EN 25164); the motor octane number (MON) of the gasoline may conveniently be at least 70, for instance in the range of from 70 to 110, preferably the MON of the gasoline will be at least 75, for instance in the range of from 75 to 105, more preferably the MON of the gasoline will be at least 80, for instance in the range of from 80 to 100, most preferably the MON of the gasoline will be at least 82, for instance in the range of from 82 to 95 (EN 25163).

Typically, gasolines comprise components selected from one or more of the following groups; saturated hydrocarbons, olefinic hydrocarbons, aromatic hydrocarbons, and oxygenated hydrocarbons. Conveniently, the gasoline may comprise a mixture of saturated hydrocarbons, olefinic hydrocarbons, aromatic hydrocarbons, and, optionally, oxygenated hydrocarbons.

Typically, the olefinic hydrocarbon content of the gasoline is in the range of from 0 to 40 percent by volume based on the gasoline (ASTM D1319); preferably, the olefinic hydrocarbon content of the gasoline is in the range of from 0 to 30 percent by volume based on the gasoline, more preferably, the olefinic hydrocarbon content of the gasoline is in the range of from 0 to 20 percent by volume based on the gasoline.

Typically, the aromatic hydrocarbon content of the gasoline is in the range of from 25 to 50 percent by volume based on the gasoline (ASTM D1319), for instance the aromatic hydrocarbon content of the gasoline is in the range of from 30 to 35 percent by volume based on the gasoline.

The benzene content of the gasoline is at most 1 percent by volume, preferably 0.5 percent or less, based on the gasoline.

The gasoline preferably has a low or ultra low sulphur content, for instance at most 1000 ppmw (parts per million by weight), preferably no more than 500 ppmw, more preferably no more than 100, even more preferably no more than 50 and most preferably no more than even 10 ppmw.

The gasoline also preferably has a low total lead content, such as at most 0.005 g/l, most preferably being lead free—having no lead compounds added thereto (i.e. unleaded).

When the gasoline comprises oxygenated hydrocarbons, at least a portion of non-oxygenated hydrocarbons will be substituted for oxygenated hydrocarbons. The oxygen content of the gasoline may be up to 35 percent by weight (EN 1601) (e.g. ethanol per se) based on the gasoline. For example, the oxygen content of the gasoline may be up to 25 percent by weight, preferably up to 10 percent by weight. Conveniently, the oxygenate concentration will have a minimum concentration selected from any one of 0, 0.2, 0.4, 0.6, 0.8, 1.0, and 1.2 percent by weight, and a maximum concentration selected from any one of 5, 4.5, 4.0, 3.5, 3.0, and 2.7 percent by weight.

Examples of oxygenated hydrocarbons that may be incorporated into the gasoline include alcohols, ethers, esters, ketones, aldehydes, carboxylic acids and their derivatives, and oxygen containing heterocyclic compounds. Preferably, the oxygenated hydrocarbons that may be incorporated into the gasoline are selected from alcohols (such as methanol, ethanol, propanol, 2-propanol, butanol, tert-butanol, isobutanol and 2-butanol), ethers (preferably ethers containing 5 or more carbon atoms per molecule, e.g., methyl tert-butyl ether and ethyl tert-butyl ether) and esters (preferably esters containing 5 or more carbon atoms per molecule); a particularly preferred oxygenated hydrocarbon is ethanol.

When oxygenated hydrocarbons are present in the gasoline, the amount of oxygenated hydrocarbons in the gasoline may vary over a wide range. For example, gasolines comprising a major proportion of oxygenated hydrocarbons are currently commercially available in countries such as Brazil and U.S.A., e.g. ethanol per se and E85, as well as gasolines comprising a minor proportion of oxygenated hydrocarbons, e.g. E10 and E5. Therefore, the gasoline may contain up to 100 percent by volume oxygenated hydrocarbons. Preferably, the amount of oxygenated hydrocarbons present in the gasoline is selected from one of the following amounts: up to 85 percent by volume; up to 70 percent by volume; up to 65 percent by volume; up to 30 percent by volume; up to 20 percent by volume; up to 15 percent by volume; and, up to 10 percent by volume, depending upon the desired final formulation of the gasoline. Conveniently, the gasoline may contain at least 0.5, 1.0 or 2.0 percent by volume oxygenated hydrocarbons.

Examples of suitable gasolines include gasolines which have an olefinic hydrocarbon content of from 0 to 20 percent by volume (ASTM D1319), an oxygen content of from 0 to 5 percent by weight (EN 1601), an aromatic hydrocarbon content of from 0 to 50 percent by volume (ASTM D1319) and a benzene content of at most 1 percent by volume.

Also suitable for use herein are gasoline blending components which can be derived from a biological source. Examples of such gasoline blending components can be found in WO2009/077606, WO2010/028206, WO2010/000761, European patent application nos. 09160983.4, 09176879.6, 09180904.6, and U.S. patent application Ser. No. 61/312,307.

If the liquid fuel composition of the present invention contains a diesel base fuel, the liquid fuel composition is a diesel fuel composition.

The diesel fuel used as the base fuel in the present invention includes diesel fuels for use in automotive compression ignition engines, as well as in other types of engine such as for example off road, marine, railroad and stationary engines. The diesel fuel used as the base fuel in the liquid fuel composition of the present invention may conveniently also be referred to as 'diesel base fuel'.

The diesel base fuel may itself comprise a mixture of two or more different diesel fuel components, and/or be additivated as described below.

Such diesel fuels will contain one or more base fuels which may typically comprise liquid hydrocarbon middle distillate gas oil(s), for instance petroleum derived gas oils. Such fuels will typically have boiling points within the usual diesel range of 150 to 400° C., depending on grade and use. They will typically have a density from 750 to 1000 kg/m$^3$, preferably from 780 to 860 kg/m$^3$, at 15° C. (e.g. ASTM D4502 or IP 365) and a cetane number (ASTM D613) of from 35 to 120, more preferably from 40 to 85. They will typically have an initial boiling point in the range 150 to 230° C. and a final boiling point in the range 290 to 400° C. Their kinematic viscosity at 40° C. (ASTM D445) might suitably be from 1.2 to 4.5 mm$^2$/s.

An example of a petroleum derived gas oil is a Swedish Class 1 base fuel, which will have a density from 800 to 820 kg/m$^3$ at 15 C (SS-EN ISO 3675, SS-EN ISO 12185), a T95 of 320° C. or less (SS-EN ISO 3405) and a kinematic viscosity at 40° C. (SS-EN ISO 3104) from 1.4 to 4.0 mm$^2$/s, as defined by the Swedish national specification EC1.

Optionally, non-mineral oil based fuels, such as biofuels or Fischer-Tropsch derived fuels, may also form or be present in the diesel fuel. Such Fischer-Tropsch fuels may for example be derived from natural gas, natural gas liquids, petroleum or shale oil, petroleum or shale oil processing residues, coal or biomass.

The amount of Fischer-Tropsch derived fuel used in the diesel fuel may be from 0% to 100% v of the overall diesel fuel, preferably from 5% to 100% v, more preferably from 5% to 75% v. It may be desirable for such a diesel fuel to contain 10% v or greater, more preferably 20% v or greater, still more preferably 30% v or greater, of the Fischer-Tropsch derived fuel. It is particularly preferred for such diesel fuels to contain 30 to 75% v, and particularly 30 to 70% v, of the Fischer-Tropsch derived fuel. The balance of the diesel fuel is made up of one or more other diesel fuel components.

Such a Fischer-Tropsch derived fuel component is any fraction of the middle distillate fuel range, which can be isolated from the (optionally hydrocracked) Fischer-Tropsch synthesis product. Typical fractions will boil in the naphtha, kerosene or gas oil range. Preferably, a Fischer-Tropsch product boiling in the kerosene or gas oil range is used because these products are easier to handle in for example domestic environments. Such products will suitably comprise a fraction larger than 90 wt % which boils between 160 and 400° C., preferably to about 370° C. Examples of Fischer-Tropsch derived kerosene and gas oils are described in EP-A-0583836, WO-A-97/14768, WO-A-97/14769, WO-A-00/11116, WO-A-00/11117, WO-A-01/83406, WO-A-01/83648, WO-A-01/83647, WO-A-01/83641, WO-A-00/20535, WO-A-00/20534, EP-A-1101813, U.S. Pat. Nos. 5,766,274, 5,378,348, 5,888,376 and 6,204,426.

The Fischer-Tropsch product will suitably contain more than 80 wt % and more suitably more than 95 wt % iso and normal paraffins and less than 1 wt % aromatics, the balance being naphthenics compounds. The content of sulphur and nitrogen will be very low and normally below the detection limits for such compounds. For this reason the sulphur content of a diesel fuel composition containing a Fischer-Tropsch product may be very low.

The diesel fuel composition preferably contains no more than 5000 ppmw sulphur, more preferably no more than 500 ppmw, or no more than 350 ppmw, or no more than 150 ppmw, or no more than 100 ppmw, or no more than 70 ppmw, or no more than 50 ppmw, or no more than 30 ppmw, or no more than 20 ppmw, or most preferably no more than 10 ppmw sulphur.

Other diesel fuel components for use herein include the so-called "biofuels" which derive from biological materials. Examples include fatty acid alkyl esters (FARE). Examples of such components can be found in WO2008/135602. Biofuels can also comprise vegetable oils which have been hydrotreated (HVO).

The diesel base fuel may itself be additivated (additive-containing) or unadditivated (additive-free). If additivated, e.g. at the refinery, it will contain minor amounts of one or more additives selected for example from anti-static agents, pipeline drag reducers, flow improvers (e.g. ethylene/vinyl acetate copolymers or acrylate/maleic anhydride copolymers), lubricity additives, antioxidants and wax anti-settling agents.

Whilst not critical to the present invention, the base fuel or the liquid fuel composition of the present invention may conveniently include one or more optional fuel additives, in addition to the essential one or more nitrogen-containing detergent additives mentioned above, either as part of a performance additive package, or otherwise. The concentration and nature of the optional fuel additive(s) that may be included in the base fuel or the liquid fuel composition of the present invention is not critical.

Gasoline Additives

Non-limiting examples of suitable types of fuel additives that can be included in the base gasoline, or the performance additive package, or the gasoline composition or the additive blend as described above include anti-oxidants, corrosion inhibitors, detergents (other than the nitrogen-containing detergent additives described above), dehazers, antiknock additives, metal deactivators, surface or friction modifiers, valve-seat recession protectant compounds, dyes, solvents, carrier fluids, diluents and markers. Examples of suitable such additives are described generally in U.S. Pat. No. 5,855,629.

Conveniently, the fuel additives can be blended with one or more solvents to form an additive concentrate, the additive concentrate can then be admixed with the base gasoline or the gasoline composition described herein.

The (active matter) concentration of any optional additives present in the base gasoline or the gasoline composition herein is preferably up to 1 percent by weight, more preferably in the range from 5 to 2000 ppmw, advantageously in the range of from 300 to 1500 ppmw, such as from 300 to 1000 ppmw.

As stated above, the gasoline composition may also contain synthetic or mineral carrier oils and/or solvents.

Examples of suitable mineral carrier oils are fractions obtained in crude oil processing, such as brightstock or base oils having viscosities, for example, from the SN 500-2000 class; and also aromatic hydrocarbons, paraffinic hydrocarbons and alkoxyalkanols. Also useful as a mineral carrier oil is a fraction which is obtained in the refining of mineral oil and is known as "hydrocrack oil" (vacuum distillate cut having a boiling range of from about 360 to 500° C., obtainable from natural mineral oil which has been catalytically hydrogenated under high pressure and isomerized and also deparaffinized).

Examples of suitable synthetic carrier oils are: polyolefins (poly-alpha-olefins or poly (internal olefin)s), (poly)esters, (poly)alkoxylates, polyethers, aliphatic polyether amines, alkylphenol-started polyethers, alkylphenol-started polyether amines and carboxylic esters of long-chain alkanols.

Examples of suitable polyolefins are olefin polymers, in particular based on polybutene or polyisobutene (hydrogenated or nonhydrogenated).

Examples of suitable polyethers or polyetheramines are preferably compounds comprising polyoxy-$C_2$-$C_4$-alkylene moieties which are obtainable by reacting $C_2$-$C_{60}$-alkanols, $C_6$-$C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group, and, in the case of the polyether amines, by subsequent reductive amination with ammonia, monoamines or polyamines. Such products are described in particular in EP-A-310 875, EP-A-356 725, EP-A-700 985 and U.S. Pat. No. 4,877,416. For example, the polyether amines used may be poly-$C_2$-$C_6$-alkylene oxide amines or functional derivatives thereof. Typical examples thereof are tridecanol butoxylates or isotridecanol butoxylates, isononylphenol butoxylates and also polyisobutenol butoxylates and propoxylates, and also the corresponding reaction products with ammonia.

Examples of carboxylic esters of long-chain alkanols are in particular esters of mono-, di- or tricarboxylic acids with long-chain alkanols or polyols, as described in particular in DE-A-38 38 918. The mono-, di- or tricarboxylic acids used may be aliphatic or aromatic acids; suitable ester alcohols or polyols are in particular long-chain representatives having, for example, from 6 to 24 carbon atoms. Typical representatives of the esters are adipates, phthalates, isophthalates, terephthalates and trimellitates of isooctanol, isononanol, isodecanol and isotridecanol, for example di-(n- or isotridecyl) phthalate.

Further suitable carrier oil systems are described, for example, in DE-A-38 26 608, DE-A-41 42 241, DE-A-43 09 074, EP-A-0 452 328 and EP-A-0 548 617, which are incorporated herein by way of reference.

Examples of particularly suitable synthetic carrier oils are alcohol-started polyethers having from about 5 to 35, for example from about 5 to 30, $C_3$-$C_6$-alkylene oxide units, for example selected from propylene oxide, n-butylene oxide and isobutylene oxide units, or mixtures thereof. Non-limiting examples of suitable starter alcohols are long-chain alkanols or phenols substituted by long-chain alkyl in which the long-chain alkyl radical is in particular a straight-chain or branched $C_6$-$C_{18}$-alkyl radical. Preferred examples include tridecanol and nonylphenol.

Further suitable synthetic carrier oils are alkoxylated alkylphenols, as described in DE-A-10 102 913.6.

Mixtures of mineral carrier oils, synthetic carrier oils, and mineral and synthetic carrier oils may also be used.

Any solvent and optionally co-solvent suitable for use in fuels may be used. Examples of suitable solvents for use in fuels include: non-polar hydrocarbon solvents such as kerosene, heavy aromatic solvent ("solvent naphtha heavy", "Solvesso 150"), toluene, xylene, paraffins, petroleum, white spirits, those sold by Shell companies under the trademark "SHELLSOL", and the like. Examples of suitable co-solvents include: polar solvents such as esters and, in particular, alcohols (e.g. t-butanol, i-butanol, hexanol, 2-ethylhexanol, 2-propyl heptanol, decanol, isotridecanol, butyl glycols, and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available).

Dehazers/demulsifiers suitable for use in liquid fuels are well known in the art. Non-limiting examples include glycol oxyalkylate polyol blends (such as sold under the trade designation TOLAD™ 9312), alkoxylated phenol formaldehyde polymers, phenol/formaldehyde or $C_{1-18}$ alkylphenol/-formaldehyde resin oxyalkylates modified by oxyalkylation with $C_{1-18}$ epoxides and diepoxides (such as sold under the trade designation TOLAD™ 9308), and $C_{1-4}$ epoxide copolymers cross-linked with diepoxides, diacids, diesters, diols, diacrylates, dimethacrylates or diisocyanates, and blends thereof. The glycol oxyalkylate polyol blends may be polyols oxyalkylated with $C_{1-4}$ epoxides. The $C_{1-18}$ alkylphenol phenol/-formaldehyde resin oxyalkylates modified by oxyalkylation with $C_{1-18}$ epoxides and diepoxides may be based on, for example, cresol, t-butyl phenol, dodecyl phenol or dinonyl phenol, or a mixture of phenols (such as a mixture of t-butyl phenol and nonyl phenol). The dehazer should be used in an amount sufficient to inhibit the 532 hazing that might otherwise occur when the gasoline without the dehazer contacts water, and this amount will be referred to herein as a "haze-inhibiting amount." Generally, this amount is from about 0.1 to about 20 ppmw (e.g. from about 0.1 to about 10 ppm), more preferably from 1 to 15 ppmw, still more preferably from 1 to 10 ppmw, advantageously from 1 to 5 ppmw based on the weight of the gasoline.

Further customary additives for use in gasolines are corrosion inhibitors, for example based on ammonium salts of organic carboxylic acids, said salts tending to form films, or of heterocyclic aromatics for nonferrous metal corrosion protection; antioxidants or stabilizers, for example based on amines such as phenyldiamines, e.g. p-phenylenediamine, N,N'-di-sec-butyl-p-phenyldiamine, dicyclohexylamine or derivatives thereof or of phenols such as 2,4-di-tert-butylphenol or 3,5-di-tert-butyl-4-hydroxy-phenylpropionic acid; anti-static agents; metallocenes such as ferrocene; methylcyclo-pentadienylmanganese tricarbonyl; lubricity additives, such as certain fatty acids, alkenylsuccinic esters, bis(hydroxyalkyl) fatty amines, hydroxyacetamides or castor oil; and also dyes (markers). Amines may also be added, if appropriate, for example as described in WO 03/076554. Optionally anti valve seat recession additives may be used such as sodium or potassium salts of polymeric organic acids.

The gasoline compositions herein can also comprise a detergent additive, in addition to the essential nitrogen-containing detergent additive mentioned above. Suitable detergent additives include those disclosed in WO2009/50287, incorporated herein by reference.

The gasoline fuel and gasoline performance packages compositions can also comprise friction modifiers, viscosity control agents, and mixtures thereof, such as those disclosed in WO2012163935.

In the above, amounts (concentrations, % vol, ppmw, % wt) of components are of active matter, i.e. exclusive of volatile solvents/diluent materials.

Diesel Additives

Detergent-containing diesel fuel additives are known and commercially available. Such additives may be added to diesel fuels at levels intended to reduce, remove, or slow the build-up of engine deposits. Examples are detergents (other than the nitrogen-containing detergent additive described above); lubricity enhancers; dehazers, e.g. alkoxylated phenol formaldehyde polymers; anti-foaming agents (e.g. polyether-modified polysiloxanes); ignition improvers (cetane improvers) (e.g. 2-ethylhexyl nitrate (EHN), cyclohexyl nitrate, di-tert-butyl peroxide, those peroxide compounds disclosed in WO96/03397 and WO99/32584 and those ignition improvers disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); metal deactivators; combustion improvers; static dissipator additives; cold flow improvers; and wax anti-settling agents.

The diesel fuel additive mixture may contain a lubricity enhancer, especially when the diesel fuel composition has a low (e.g. 500 ppmw or less) sulphur content. In the additivated diesel fuel composition, the lubricity enhancer is conveniently present at a concentration of less than 1000 ppmw, preferably between 50 and 1000 ppmw, more preferably between 70 and 1000 ppmw. Suitable commercially available lubricity enhancers include ester- and acid-based additives. Other lubricity enhancers are described in the patent literature, in particular in connection with their use in low sulphur content diesel fuels, for example in:

- the paper by Danping Wei and H. A. Spikes, "The Lubricity of Diesel Fuels", Wear, III (1986) 217-235;
- WO-A-95/33805—cold flow improvers to enhance lubricity of low sulphur fuels;
- U.S. Pat. No. 5,490,864—certain dithiophosphoric diester-dialcohols as anti-wear lubricity additives for low sulphur diesel fuels; and
- WO-A-98/01516—certain alkyl aromatic compounds having at least one carboxyl group attached to their aromatic nuclei, to confer anti-wear lubricity effects particularly in low sulphur diesel fuels.

It may also be preferred for the diesel fuel composition to contain an anti-foaming agent, more preferably in combination with an anti-rust agent and/or a corrosion inhibitor and/or a lubricity enhancing additive.

Unless otherwise stated, the (active matter) concentration of each such optional additive component in the additivated diesel fuel composition is preferably up to 10000 ppmw, more preferably in the range from 0.1 to 1000 ppmw, advantageously from 0.1 to 300 ppmw, such as from 0.1 to 150 ppmw.

The (active matter) concentration of any dehazer in the diesel fuel composition will preferably be in the range from 0.1 to 20 ppmw, more preferably from 1 to 15 ppmw, still more preferably from 1 to 10 ppmw, and especially from 1 to 5 ppmw. The (active matter) concentration of any ignition improver (e.g. 2-EHN) present will preferably be 2600 ppmw or less, more preferably 2000 ppmw or less, even more preferably 300 to 1500 ppmw. The (active matter) concentration of any detergent in the diesel fuel composition will preferably be in the range from 5 to 1500 ppmw, more preferably from 10 to 750 ppmw, most preferably from 20 to 500 ppmw.

In the case of a diesel fuel composition, for example, the fuel additive mixture will typically contain a detergent, optionally together with other components as described above, and a diesel fuel-compatible diluent, which may be a mineral oil, a solvent such as those sold by Shell companies under the trade mark "SHELLSOL", a polar solvent such as an ester and, in particular, an alcohol, e.g. hexanol, 2-ethylhexanol, decanol, isotridecanol and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available.

The total content of the additives in the diesel fuel composition may be suitably between 0 and 10000 ppmw and preferably below 5000 ppmw.

In the above, amounts (concentrations, % vol, ppmw, % wt) of components are of active matter, i.e. exclusive of volatile solvents/diluent materials.

The liquid fuel composition herein is preferably a gasoline fuel composition or a diesel fuel composition, especially a gasoline fuel composition. The liquid fuel composition herein can also be used for other purposes such as an aviation gasoline composition or as a marine fuel composition, and the like.

Process of Preparing the Liquid Fuel Composition

The liquid fuel composition of the present invention can be produced by admixing the essential one or more nitrogen-containing detergent additives, preferably as part of a performance additive package, with a gasoline or diesel base fuel suitable for use in an internal combustion engine.

The present invention will be further understood from the following examples. Unless otherwise stated, all amounts and concentrations disclosed in the examples are based on weight of the fully formulated fuel composition.

Examples

Various lubricating compositions were prepared by combining a base oil (GTL 4, a Fischer-Tropsch derived base oil having a kinematic viscosity at 100° C. of approximately 4 cSt, available from Shell) with ZDTP. The ZDTP was added in an amount so as to provide 0.08 wt % phosphorus in the final lubricating composition. The formulations also contained a nitrogen-containing detergent additive (designated as D1, D2 in Table 1 below) in varying amounts to give lubricating compositions having varying amounts of nitrogen (0.05 wt % N, 0.07 wt % N or 0.1 wt % N, by weight of the final lubricating compositions). Carbon black was also added to the lubricating compositions in an amount of 5 wt %, by weight of the final lubricating compositions, in order to simulate the effect of the presence of soot in the lubricant.

The nitrogen-containing detergents used in the present examples were polyisobutylene succinimides having the tradename Infineum C9280 (containing 1.2 wt % N) commercially available from Infineum (designated as D1 in Table 1 below) and OLOA11000 commercially available from Chevron Oronite (designated as D2 in Table 1 below).

HFRR Wear Test

The lubricant formulations were subjected to a HFRR wear test. The HFRR (High-Friction Reciprocating Rig) is a controlled reciprocating friction and wear testing device employed to assess the performance of fuels and lubricants. The test uses a 6 mm diameter steel ball loaded and reciprocated against the flat surface of a stationary steel disc immersed in lubricant. At the end of each test, the ball and disc were removed from the test rig, rinsed with toluene and iso-propanol, and then treated with a 0.05 wt % solution of ethylenediaminetetraacetic acid (EDTA) for 60 s. This was to remove any ZDTP anti-wear film on the surfaces since it can interfere with optically-based wear measurement. Topography images were then obtained and analysed to determine wear volumes of the wear scars on the ball and the disc using the SWLI Veeco Wyko model NT9100. The instrument was set in Vertical Scanning Interferometry (VSI) mode, calibrated to measure rough surfaces with a nanometre detection range.

The results of these wear tests are shown in Table 1 below.

TABLE 1

| | HFRR Wear Volume ($\mu m^3$) | | |
|---|---|---|---|
| Dispersant | 0.05 wt % N | 0.07 wt % N | 0.1 wt % N |
| D1 | 143829 | 105100 | 105046 |
| D2 | 61322 | 60022 | 55354 |

Discussion

From the results in Table 1 it can be seen that the wear properties of the ZDTP-containing lubricant formulations containing the polyisobutylene succinimide detergent additives D1 and D2 improve as the level of nitrogen present in the lubricating composition increases. Hence, these results demonstrate the benefits of including a nitrogen-containing detergent additive in the fuel which is capable of transferring from the fuel to the lubricant during use, hence serving to boost the level of nitrogen-containing detergent additive in the ZDTP-containing lubricant and enhancing the wear properties of the ZDTP-containing lubricant in the presence of soot (i.e. reducing the wear exhibited by the ZDTP-Containing lubricant in the presence of soot).

That which is claimed is:

1. Method for reducing engine wear in a direct injection gasoline engine caused by the presence of accumulated soot in a lubricating composition used to lubricate the direct injection gasoline engine, wherein the method comprises the steps of:

(i) lubricating the direct injection gasoline engine with a lubricating composition comprising at least one zinc-containing anti-wear additive selected from zinc dialkyl-, diaryl- or alkylaryl-dithiophosphates; and (ii) fueling the direct injection gasoline engine with a gasoline fuel composition comprising a gasoline base fuel in conjunction with at least one nitrogen-containing detergent additive, and optionally one or more conventional fuel additives, wherein the nitrogen-containing detergent additive is selected from compounds having at least one hydrophobic hydrocarbon radical which is a polyisobutenyl radical having a number-average molecular weight (Mn) of from 85 to 20000 and at least one polar moiety selected from:

(A3) moieties derived from succinic anhydride and having amido and/or imido groups;

wherein the nitrogen-containing detergent additive is present in the gasoline fuel composition at a level from 0.0015 wt % to 0.1 wt %, by weight of the gasoline fuel composition, and wherein the gasoline fuel composition does not contain water;

wherein the amount of accumulated soot present in the lubricating composition is at a level of from 2 wt % to 10 wt %, by weight of the lubricating composition.

2. Method according to claim 1 wherein the nitrogen-containing detergent additive is a polyisobutylene succinimide.

3. Method according to claim 1 wherein the nitrogen-containing detergent additive is present in the fuel composition at a level of from 0.0015 wt % to 0.095 wt %, by weight of the fuel composition.

4. Method according to claim 1 wherein the amount of accumulated soot present in the lubricating composition is from 3.5 to 10 wt %, by weight of the lubricating composition.

5. Method according to claim 1, wherein the amount of accumulated soot present in the lubricating composition is from 5 to 10 wt %, by weight of the lubricating composition.

* * * * *